United States Patent [19]

Rhodes

[11] 4,259,560

[45] Mar. 31, 1981

[54] PROCESS FOR DRYING COAL AND OTHER CONDUCTIVE MATERIALS USING MICROWAVES

[76] Inventor: George W. Rhodes, 7921 Hendrix, NE., Alburquerque, N. Mex. 87110

[21] Appl. No.: 835,276

[22] Filed: Sep. 21, 1977

[51] Int. Cl.[3] ..... H05B 6/64

[52] U.S. Cl. ..... 219/10.55 M; 34/1; 34/4; 44/10 J; 219/10.55 A

[58] Field of Search ..... 219/10.55 A, 10.55 M, 219/10.55 R; 34/4, 1; 44/10 E, 10 J

[56] References Cited

U.S. PATENT DOCUMENTS

| | | | |
|---|---|---|---|
| 3,446,929 | 5/1969 | Smith | 219/10.55 A |
| 3,463,310 | 8/1969 | Ergu et al. . | |
| 3,555,693 | 1/1971 | Futer | 219/10.55 A |
| 3,560,347 | 2/1971 | Knapp et al. | 219/10.55 A |
| 3,704,523 | 12/1972 | Guerga et al. | 219/10.55 A X |
| 3,953,703 | 4/1976 | Hurwitt | 219/10.55 M |
| 4,045,638 | 8/1977 | Chiang et al. | 219/10.55 A |
| 4,045,639 | 8/1977 | Meisel | 219/10.55 M X |
| 4,065,361 | 12/1977 | Hanson | 219/10.55 A X |
| 4,147,911 | 4/1979 | Nishitani | 219/10.55 M |

*Primary Examiner*—Arthur T. Grimley
*Attorney, Agent, or Firm*—Ronald R. Snider

[57] ABSTRACT

A process for drying a conductive material, particularly coal, by subjecting the material to microwave energy is disclosed. A conductive aggregate is directed through a region where microwave energy excites absorbed water molecules and the conductive material causing the water to evaporate, leaving behind a drier material.

10 Claims, 2 Drawing Figures

PROCESS FOR DRYING COAL AND OTHER CONDUCTIVE MATERIALS USING MICROWAVES

BACKGROUND OF THE INVENTION

1. Field Of The Invention

The present invention relates to a process for drying conductive material, particularly coal particles and coal fines, using microwave energy. In accordance with the present invention, a fine powdery coal aggregate is dried without using intensely heated gases and risking igniting the fine aggregate.

2. Discussion Of The Prior Art

In the prior art, microwaves have been used to dry and dehydrate non-conducting materials, such as food products. These microwave techniques depend on the presence of polar molecules to induce the heating effect. This is known as dielectric heating. As microwaves pass through the material to be heated, polar molecules, such as water molecules vibrate rapidly as they attempt to align themselves with the constantly changing electric field in the microwave. When a wet conductive material is subjected to microwave radiation, the water molecules are caused to vibrate in the same way they are caused to vibrate with non-conducting materials. However, microwave radiation of conductive materials is accompanied by an additional effect which has led those skilled in the art away from using microwaves to dry conductive material. When a conductive material is subjected to microwave radiation, the atoms which make up the material absorb and conduct the microwave energy so efficiently that arcing can occur, thus igniting the material to be dried, resulting in damage to the product. Unlike non-conducting materials the atoms of which are transparent to microwave radiation, the atoms of conductive materials are more susceptable to the production of free electrons which can be induced by microwave radiation. This enables arcing to occur. Consequently, one skilled in the art would not expect microwaves to be useful in drying conductive materials since the arcing phenomena would be expected to occur, thus rendering the process useless. I have discovered that by reducing the size of conductive particles like coal, I can prevent arcing and thereby dry the material using microwaves.

The application of microwave technology to drying coal has special advantages. After mining, metallurgical coal is pulverized into small particles and passed through a washing plant to remove both ash and sulfur. Subsequently, the aggregate is centrifuged to remove the wash water. After centrifuging, the coal still contains about 15% absorbed water which must be removed before the coal can be used for coking for which the water content must be on the order of 6% or less. Consequently, the coal particles must be dried further and following standard technology this means that intensely heated gases from an electrical or gas furnace are blown through the fine particles in a fluidized bed treatment.

There are several disadvantages to drying coal using intensely heated gases. A source of intensely heated gases must be provided, and this requires large volumes of air and a furnace of some type. Additionally, about 20% of the aggregate ends up at a size less than 28 mesh. The small size of this fraction aggrevates the drying process. As heated gases are blown through the aggregate, the powdery material is picked up by the gases.

Unlike the larger particles, the powdery materials create a dust problem. The powdery materials do not settle easily and they tend to coat the inside of the drying apparatus, as well as to be carried out of the apparatus with the exhaust gases. Accordingly, for environmental reasons, special steps must be taken in the drying facility to remove the powder from gases and to contain the powdery material. In addition, the powdery material is extremely flammable. As the heated gases become saturated with the powder, a potentially dangerous condition develops where the slightest degree of overheating could ignite the powder and start an intense fire within the drying facility. Accordingly, the conventional drying must be carefully monitored to prevent the powder from igniting.

In accordance with the present invention, the foregoing disadvantages are overcome. First, the microwave drying facility is principally made up of a microwave generator, waveguides to direct the microwave beam, and a chamber or cavity where the beam irradiates the material to be dried. No furnace or large volume of heated gas is required to operate the microwave facility; however, heated air may be passed through the apparatus to assist in the removal of water vapor from the chamber. Since the material to be dried need not be bathed in the warm air, turbulent mixing is not necessary. Second, microwave energy id directed to the surface of the coal particles where the water is absorbed and consequently where the energy is most effectively used to drive the water from the coal. While the microwave drying process can be assisted by stirring the aggregate, again, it is not necessary to blow the aggregate around and create the dust problem which hampers the conventional technique. Finally, because the microwave energy can be directed to the surface of the coal particles, it is not necessary to generate the intense heat conditions which raise the risk of fire igniting the coal.

The following list of U.S. patents relates to microwave drying of non-conducting materials: U.S. Pat. Nos. 3,409,447, 3,432,636, 4,015,341 (grain and food products); 3,775,860 (timber); 2,483,623, 3,184,575, 3,771,234 (oil and polymer); 3,831,288, 3,997,388 (organic fertilizers); 3,528,179 (generally).

SUMMARY OF THE INVENTION

The primary object of the present invention is to overcome the problems which hamper conventional coal drying operations by using microwaves.

It is a further object of the present invention to dry a conductive material which has not conventionally been dried using microwaves by reducing the size of the conducting material such that arcing does not occur when microwaves are applied.

Another object of this invention is to dry coal particles using a form of energy which can be directed to the surface of the coal particles where it is most effectively used to drive the water from the coal without igniting the valuable fine coal aggregate.

Another object of this invention is to dry conductive materials using a technology which does not waste energy on the surroundings, and costs but a fraction of the cost of existing systems to install and operate.

It is still another object of this invention to use microwave technology to heat concrete and conductive (inorganic) fertilizers.

DETAILED DESCRIPTION OF THE INVENTION

Figure 1:
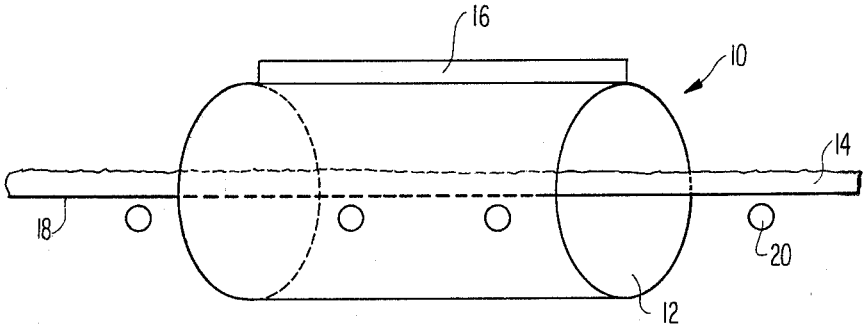
FIG. 1 is a schematic diagram of an apparatus which may be used to practice the present invention.

The present invention will be best understood upon consideration of the following discussion and detailed description of the drawings.

This application is directed primarily to drying coal particles. However, the invention disclosed herein is suitable for drying a variety of conducting materials, such as concrete and inorganic fertilizers. In accordance with the present invention, a conductive material is dried without arcing by making the particle size of the material small enough that arcing does not occur. As pointed out above, conductive materials, unlike nonconducting materials, are not transparent to microwaves. They can conduct the microwave energy so efficiently that in the microwave cavity one experiences an inhomogeneous field as a result of cavity modes and intense spots can occur which, if of sufficient distance and conductivity, will create surface breakdown or arcing. I describe that conductive distance as a mean free path for arcing. In order to use microwaves to dry coal or other conductive aggregates, the size of the coal must be maintained less than the mean free path for arcing—i.e., small enough that arcing does not occur at the incident microwave power. This maximum size for the particle can be determined quite readily on a trial-and-error basis by making a series of pilot runs. I have found that it is practical and desirable to dry coal particles which are less than about 1 inch in diameter using microwaves at 915 MHz. At 2450 MHz, one would expect the maximum size for the coal to be slightly smaller. Again, this can be readily determined by making a trial run.

While the arcing phenomena is a function of both conductance of the material to be dried and incident power, economic practicality dictates that one apply as much power as possible in a small volume to facilitate ease of handling and minimum capital investment. Accordingly, as a practical matter, one will apply as much power as is possible to a given size aggregate without causing arcing to occur.

It is also clear that the present invention can be used to dry materials which are wetted with liquids other than water. Generally, any polar liquid can be dried by this type of microwave heating up to its ignition temperature. As indicated above, in order to evaporate water or any solvent, either the solvent molecule itself must absorb microwaves or heating must occur at the interface of the particle and the absorbed wetness.

The term "microwaves" as it is used throughout this specification means electromagnetic radiation at about 800 to 2500 MHz. Practically speaking, however, only two frequencies, 915 MHz and 2450 MHz, will be used since these are the only two frequencies allotted by the Federal Communications Commission for commercial heating.

The intensity of the microwaves can also be adjusted for the moisture content of the material to be dried. For example, if coal is on the relatively wet side, e.g., contains 20% absorbed water, and it is desired to dry the material completely, a microwave intensity of 10 $w/cm^2$ may be used. Of course, a lower intensity can be used with an accompanying increase in drying time. If the coal is relatively dry, e.g., 10% absorbed water, or if it is not desired to dry the material completely, 1 $w/cm^2$ intensity may be used. Similar parameters can be determined for other conducting materials and wetting liquids on a trial-and-error basis.

One feature of this invention is that the intensity of the microwave may be controlled to regulate the water content of the "dried" material in real time. In one embodiment of my invention, I provide an infrared detector which is used to measure the amount of water in the microwave cavity. The information supplied from this detector may be fed back to the microwave generator and used to adjust the intensity of the microwave. A laser diode operating on an infrared absorption band of the water molecule strikes the surface of the aggregate, thus scattering the radiation. An optical detector then measures the amount of water present and feeds the information to a microprocessor. This microprocessor is programmed to switch on or off the microwave sources as required to maintain the programmed amount of water.

Any conventional means of generating microwaves, such as magnetrons or klystrons, may be used in this process. The microwaves so generated are directed to the cavity where they are absorbed by the conducting material using one or more wave guides in a manner well known in the art.

The present invention will be further understood by reference to FIG. 1 where apparatus 10 comprises a microwave cavity 12 where coal particles 14 (or other conductive aggregate) are dried by microwaves directed to cavity 12 by wave guide 16. The coal particles are carried to cavity 12 by means of conveyor belt 18 which rides on rollers 20. The conveyor belt and the rollers, as well as any other body passing through the microwave cavity (outside of the material to be dried) should be constructed of, but is not restricted to, a material which does not absorb microwaves in the range transmitted by the microwave source in a manner consistent with well-known microwave engineering. The microwaves are generated by a conventional generating means not shown in the figure. The coal is conveyed into the cavity where it remains until it has reached the level of dryness desired. Because the particles dried in accordance with the present are conductive, care must be taken that the particles are not too large a size that arcing occurs within the microwave cavity.

Figure 2:
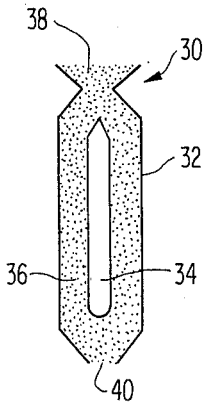
FIG. 2 is a schematic diagram of another arrangement which may also be used in accordance with the present invention.

In FIG. 2, apparatus 30 comprises a vertically disposed cylindrical microwave cavity 32 having a centrally located microwave source 34. Coal particles enter the cavity via inlet 38 where they are dried as they fall freely past microwave source 34 and exit the cavity via outlet 40.

A suitable moisture content detector may be positioned in the microwave cavity so as to detect the moisture content of the aggregate. One such moisture detector particularly suited for measuring the moisture content of coal particles is the infrared detector discussed above.

In addition, a vacuum may be provided to assist in evaporation of the water and removal of the steam generated by the microwave treatment. The design of the apparatus illustrated in FIG. 2 is particularly well suited for application of a vacuum. Air may be circulated or blown through the cavity to assist in removing evaporated water.

Furthermore, the apparatus may be equipped with a means for stirring the aggregate while it is in the microwave cavity. Microwave beams penetrate the aggregate to a depth which depends on the species being irradiated. This depth is not always sufficient for the microwaves to reach all the aggregate within the cavity. The process can be assisted by paddles or equivalent means for stirring the aggregate and renewing the surfaces exposed to the microwave radiation. Of course, the paddles, like the conveyor belts and rollers, should be constructed of a material which does not absorb in the wave length region of the microwave source.

An optimization of the microwave power with a heated air mass can also be made. The clean water obtained from the aggregate can be returned to a washing facility. In a conventional drying plant, this could not be done because the water is contaminated with sulfur particles.

While the invention has been described in detail with reference to specific embodiments thereof, it will be apparent to one skilled in the art that various changes and modifications can be made therein without departing from the spirit and scope thereof.

I claim:

1. A process for removing a polar liquid from a conductive aggregate, wherein said conductive aggregate is of the type which is susceptible to the production of free electrons which can be induced by microwave radiation, comprising the steps of:

(a) reducing the size of the said conductive aggregate into fine particles which are smaller then the mean free path required to support arc formation at a predetermined microwave power level;

(b) subjecting said conductive aggregate to said predetermined microwave radiation, whereby said polar liquid is removed due to the motion induced in said liquid by said microwaves.

2. The process of claim 1 wherein said polar liquid is water.

3. The process of claims 1 and 2 wherein said conductive aggregate is coal.

4. The process of claim 1 further including the step of circulating air in the region of the conductive aggregate to assist in removing evaporated polar liquid.

5. The process of claim 1 wherein said predetermined microwave power level is within the range of one to ten watts per centimeter squared.

6. The process of claim 1 wherein said particle diameter is less than one inch.

7. The process of claim 1 wherein said conductive aggregate is coal of an average diameter, less than one inch, and said polar liquid is water.

8. Process of claim 1, 2 and 5 wherein said conductive aggregate is not transparent to microwaves.

9. The process of claim 1 wherein the conductive material is concrete.

10. The process of claim 1 wherein the conductive material is a conductive fertilizer.

* * * * *